United States Patent [19]

Wise

[11] 4,319,859

[45] Mar. 16, 1982

[54] DITCH LINING APPARATUS

[75] Inventor: James W. Wise, Woodleaf, N.C.

[73] Assignee: Power Curbers, Inc., Salisbury, N.C.

[21] Appl. No.: 142,382

[22] Filed: Apr. 21, 1980

[51] Int. Cl.[3] ..... E02B 5/02; E01C 19/48

[52] U.S. Cl. ..... 405/268; 404/96; 404/98

[58] Field of Search ..... 405/268; 404/84, 96, 404/98, 104

[56] References Cited

U.S. PATENT DOCUMENTS

| | | | |
|---|---|---|---|
| 3,636,833 | 1/1972 | Lowen et al. | 404/84 |
| 3,646,767 | 3/1972 | Shelley | 405/268 X |
| 3,710,695 | 1/1973 | Miller et al. | 404/98 |
| 3,749,504 | 7/1973 | Smith | 404/84 |
| 3,792,133 | 2/1974 | Goughnour | 264/33 |
| 4,013,375 | 3/1977 | Heaton | 404/98 |

*Primary Examiner*—David H. Corbin

*Attorney, Agent, or Firm*—Bell, Seltzer, Park & Gibson

[57] ABSTRACT

A self-propelled apparatus for extruding and forming a substantially U-shaped concrete lining within a previously dug ditch and including means for accurately controlling the slope or grade of the interior bottom surface of the lining. The apparatus includes a hopper (41) for receiving concrete material and the lower end of the hopper is positioned within the ditch (10) and provided with an open rear end. A forming member (50) is supported for vertical movement at the open rear end of the hopper (41) and the forming member (50) with the sides and bottom of the ditch (10) together define an extrusion opening through which the concrete material passes. Control means (76) is associated with the forming member (50) for vertically adjusting the forming member (50) relative to the hopper (41) so that the slope, grade, or fall of the interior bottom wall (14) of the concrete lining is accurately controlled.

14 Claims, 9 Drawing Figures

DITCH LINING APPARATUS

FIELD OF THE INVENTION

This invention relates generally to a self-propelled apparatus for extruding and forming a substantially U-shaped concrete lining within a previously dug ditch, and more particularly to such an apparatus with means for accurately controlling, to very close tolerances, the slope or grade of the interior bottom surface of the lining.

BACKGROUND OF THE INVENTION

Water, for irrigation and other purposes, is often carried by a system of ditches and the inner surfaces of these ditches are often lined with concrete or other suitable paving material. In some instances, movement or flow of the water is induced and controlled by pumps and valves or gates and in other instances, it is highly desirable to induce and control the movement or flow of the water by means of the slope or fall of the ditches in the system. In these latter instances, it is essential that the slope, grade, or fall of the ditches be accurately controlled to very close tolerances. For example, the specification of one installation required a slope of 30 cm. per 200 meters with a tolerance of plus or minus 1 cm.

Heretofore, attempts to accurately control the slope or fall of such ditches have essentially involved digging such ditches with a slope as close to the desired slope as possible and then to line the ditches with a liner of uniform thickness. As can be readily appreciated, it is virtually impossible to dig any ditch with powered digging machines to any reasonably close tolerances and hand labor is very time-consuming and costly. Further, even with hand labor very close tolerances in the slope or fall of the bottom of the ditch being dug is very difficult to achieve.

Another prior attempt has involved building forms along the ditch and filling the forms with concrete. Then, the forms are removed when the concrete is partially set. The building and removal of the forms are costly and time-consuming operations and also present problems in the finishing of certain surfaces of the concrete within the ditch.

Several different types of devices have been proposed for forming concrete linings in ditches and the like. However, the slope or fall of the bottom of the lining has been dependent upon the slope imparted to the ditch when it is being dug. Therefore, such devices suffer from the same deficiencies as discussed above.

SUMMARY OF THE INVENTION

With the foregoing in mind, it is an object of the present invention to provide a self-propelled apparatus for extruding and forming a substantially U-shaped concrete lining within a previously dug ditch while accurately controlling, to close tolerances, the slope of the interior bottom surface of the lining to thereby accurately control the flow of water in the ditch.

The ditch lining apparatus of the present invention includes a prime mover for propelling the apparatus along the ground surface and adjacent the previously dug ditch. The prime mover includes a frame with a plurality of rotatable drive members supporting the frame and primary control means is associated with the prime mover for following a predetermined path of travel adjacent the ditch and for vertically adjusting the frame member relative to the rotatable drive members to maintain the frame moving at a predetermined elevation. A hopper is carried by the frame and extends downwardly into the ditch. Mold means is supported on the frame and communicates with the hopper for receiving concrete material from the hopper and for molding the material into a substantially U-shaped lining within the ditch and in covering relationship to the bottom and sides thereof as the apparatus moves along the ground. The mold means including a forming member in the form of a slip mold is supported for vertical movement within the open rear end of the hopper and is substantially U-shaped in cross-section. The outer surface of the forming member and the sides and bottom of the ditch together define an extrusion opening through which the concrete material passes to form the U-shaped concrete lining in the ditch as the prime mover moves along the ground. Secondary control means is associated with the forming member for vertically adjusting the same relative to the frame so that the slope or fall of the interior bottom surface of the concrete lining is accurately controlled.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figures 1, 2:
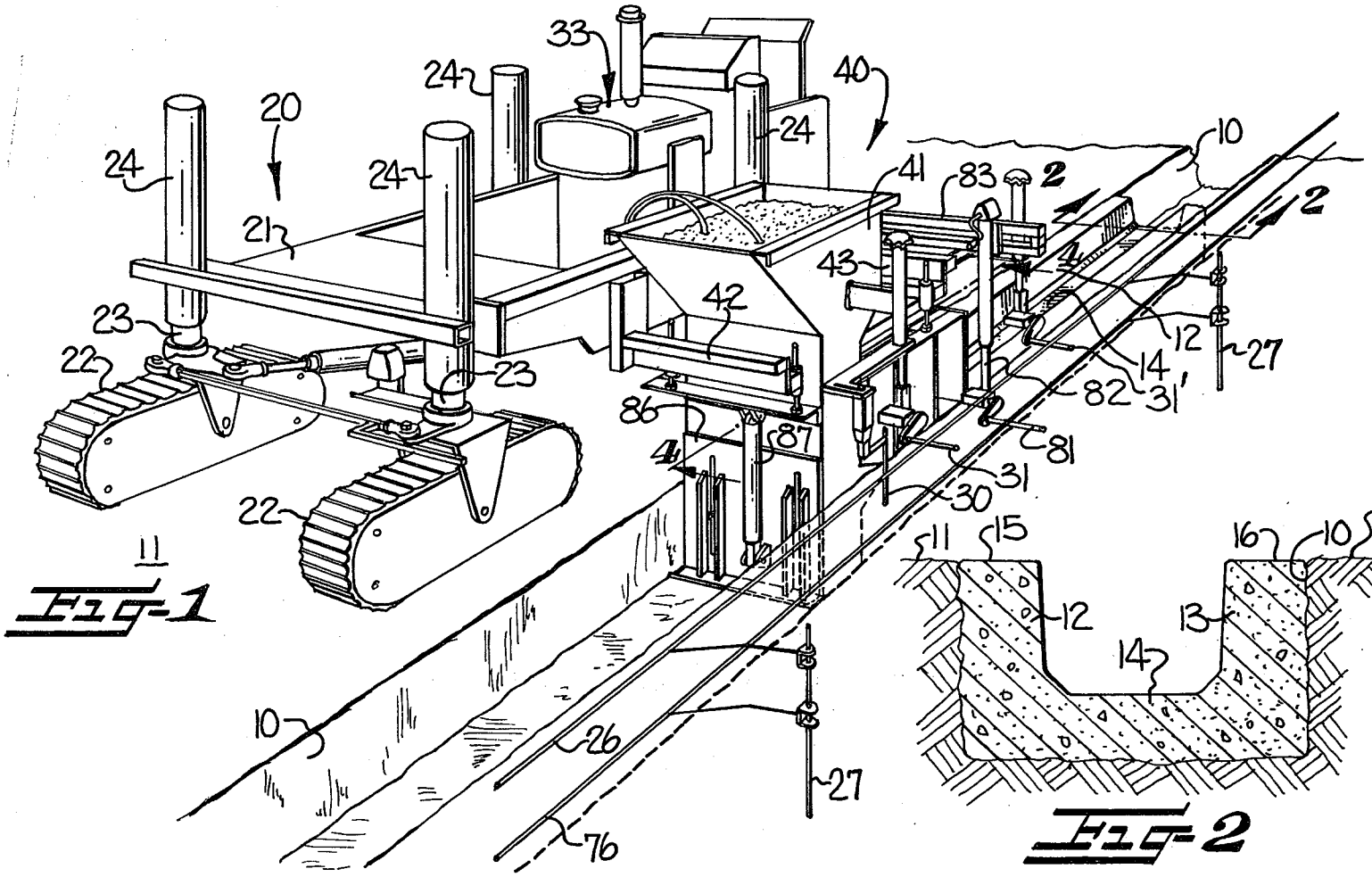
FIG. 1 is a perspective view of the ditch lining apparatus of the present invention.
FIG. 2 is an enlarged vertical sectional view taken substantially along the line 2—2 in FIG. 1 and illustrating the manner in which the previously dug ditch is lined with concrete in accordance with the present invention.

Referring particularly to FIG. 2, it will be noted that the self-propelled apparatus of the present invention is adapted for extruding and forming a substantially U-shaped concrete lining within a previously dug ditch, indicated at 10, formed in the ground 11. The concrete lining includes opposite sidewalls 12, 13, a bottom interior surface or wall 14, and upper walls 15, 16. As has been previously noted, it is important in many instances to accurately control, to close tolerances, the slope, grade or fall of the interior bottom 14 of the lining so as to control the movement of water in the ditch.

The apparatus of the present invention includes prime mover means, broadly indicated at 20, for propelling the apparatus along the ground surface 11. The prime mover means 20 includes a generally rectangular frame 21 (FIG. 1), and a plurality of rotatable drive members, illustrated as tracks 22. Only the front two drive members 22 are shown in FIG. 1 and additional drive members are positioned at opposite sides of the rear of the frame 21. The drive members 22 are supported on the lower ends of posts 23 which are in turn supported for vertical adjustment in corresponding sleeves 24, fixed on each corner of the frame 21.

Primary control means is provided for causing the prime mover 20 to follow a predetermined path of travel adjacent the previously dug ditch 10 and to vertically adjust the frame 21 relative to the drive members 22 and includes a primary control wire or line 26 (FIG. 1) which is supported at spaced-apart intervals by support stakes 27. A vertical line follower 30 and a front horizontal line follower 31 are supported on a hopper, to be presently described, and a rear horizontal line follower 31' (FIGS. 1 and 6) is carried by an arm on the frame 21. The follower 30 controls the directional movement of the prime mover 20 and the front and rear followers 31, 31' control the vertical position of the frame 21.

An internal combustion engine, broadly indicated at 33, drives a hydraulic pump for operating hydraulic motors, not shown, for imparting movement to the drive members 22 and for raising and lowering the frame 21 in accordance with the position of the control line 26. The hydraulic motors for driving of the drive members 22 and for vertical adjustment of the frame 21, by means of the primary control wire 26, are not shown but are of the type shown and described in U.S. Pat. No. 3,749,504, the disclosure of this patent being incorporated in the present disclosure by reference thereto.

In accordance with the present invention, mold means, broadly indicated at 40, is supported on and extends outwardly in offset relationship adjacent one side of the frame 21 for receiving concrete material and for directing the concrete material into the previously dug ditch 10 as the apparatus moves along the ground 11 and adjacent the ditch. A hopper 41 is supported on and maintained in a fixed position relative to the frame 21 by a forward support arm 42 which has its inner end fixed to one side of the frame 21 (FIG. 1). The upper end of the hopper 41 is open for receiving the concrete material therein and the lower end extends downwardly into the ditch 10 for directing the concrete material downwardly into the ditch 10 as the apparatus moves along the ground. The lower end of the hopper 41 includes an open rear end positioned within the ditch. A forming member support housing 44 is fixed at its forward end on the rear portion of the hopper 41 and its rear portion is supported on the outer end of a support arm 43, the inner end of which is fixed on one side of the frame 21. Thus, the hopper 41 and the forming member support housing 44 are maintained in a fixed position, relative to the frame 21, and the frame 21 is supported for vertical adjustment on the rotatable drive members 22.

Opposite side portions of the forming member housing 44 are provided with horizontal slide mold plates 45, 46 which smooth and form the upper walls 15, 16 of the concrete lining. The slide mold plates 45, 46 are vertically adjusted with vertical adjustment of the main frame 21 and generally follow the contour of the level of the ground 11 adjacent the previously dug ditch 10.

Figure 3:
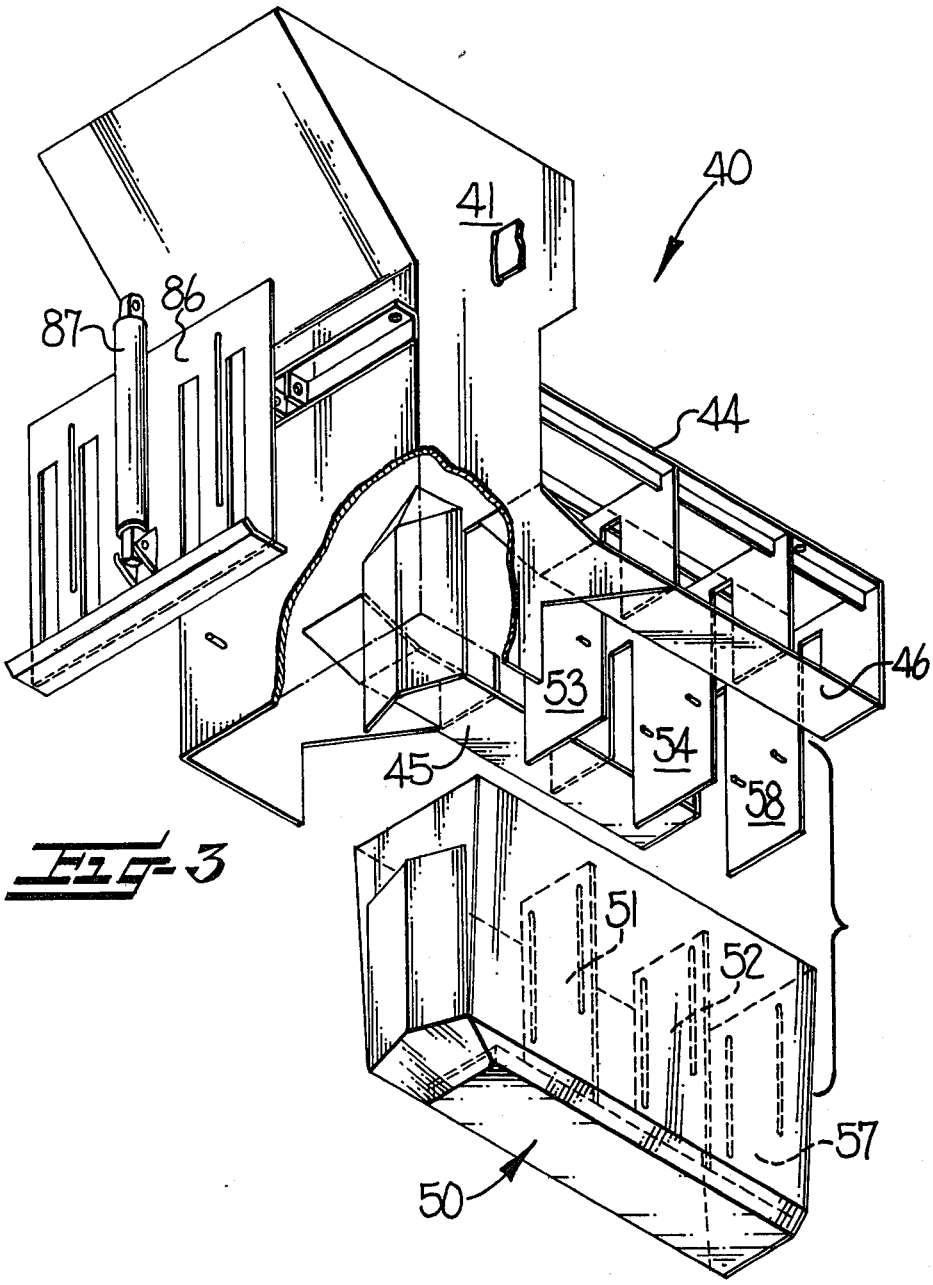
FIG. 3 is an exploded isometric view of the concrete hopper and forming member.
Figure 4:
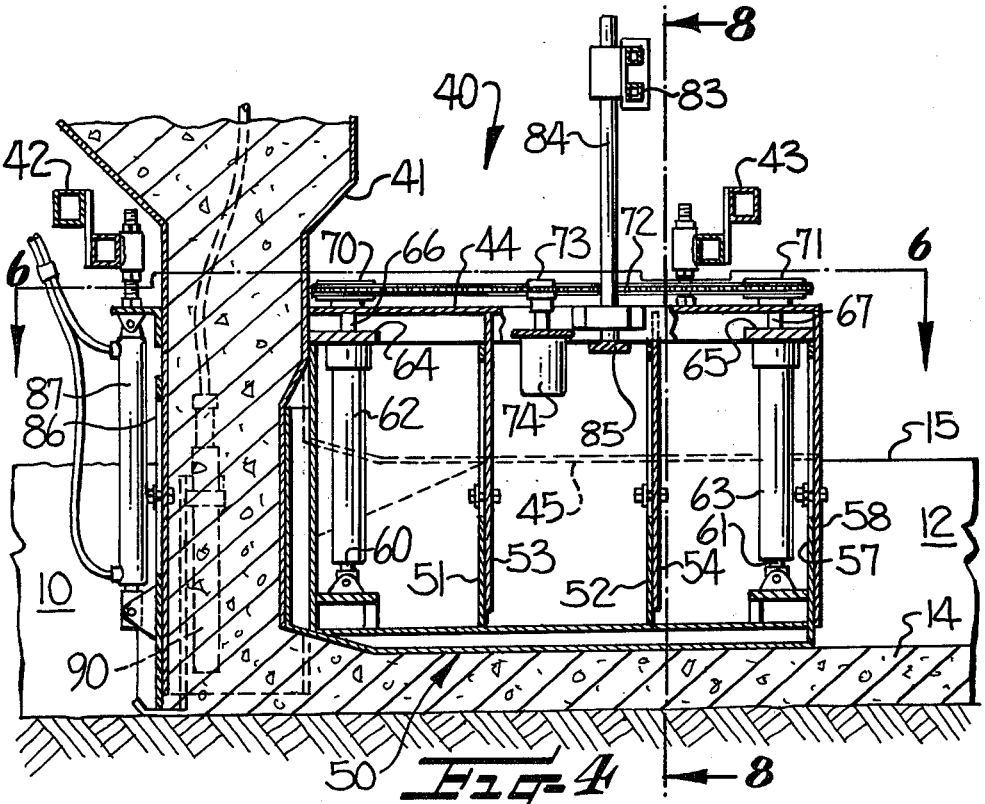
FIG. 4 is a vertical sectional view through the hopper and forming member, being taken substantially along the line 4—4 in FIG. 1.
Figure 8:
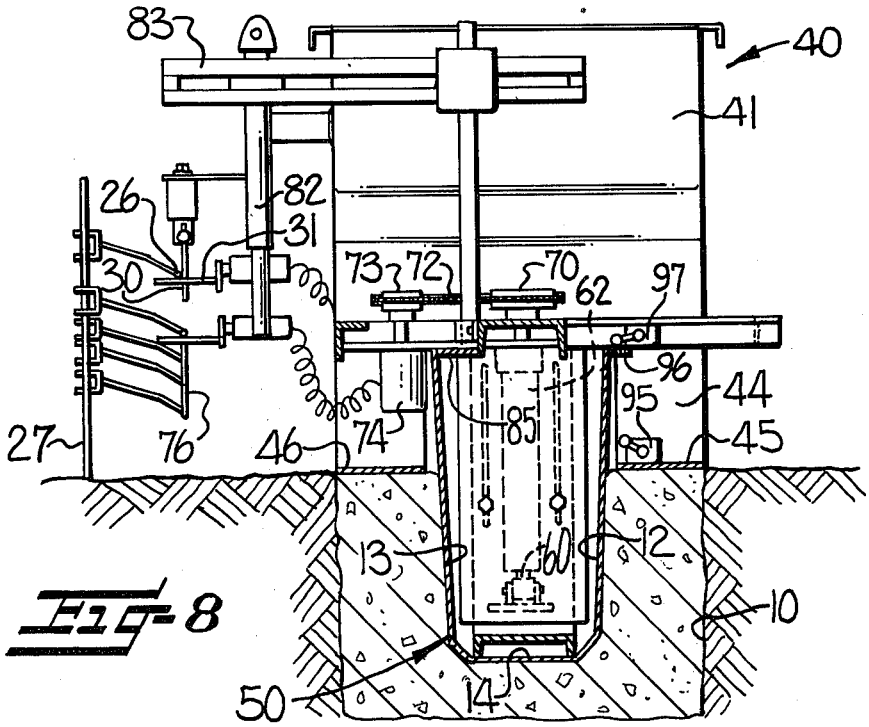
FIG. 8 is a vertical sectional view taken substantially along the line 8—8 in FIG. 4.
Figure 9:
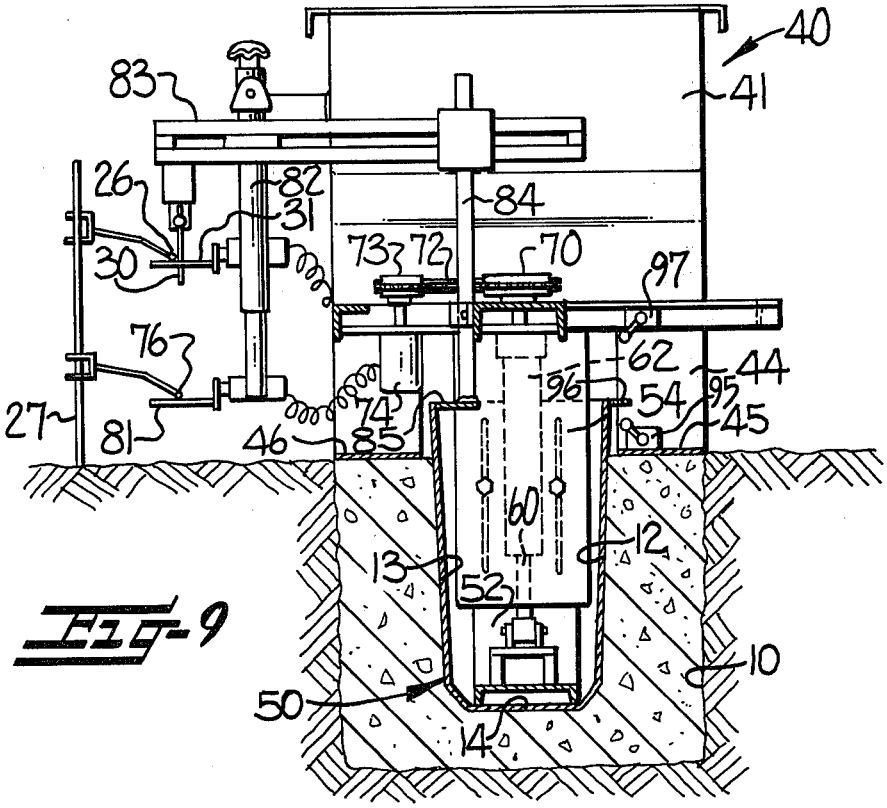
FIG. 9 is a vertical sectional view taken substantially along the line 9—9 in FIG. 5.

A forming member or slip mold, broadly indicated at 50, is supported for vertical adjustment on the forming member support housing 44 and is generally U-shaped in cross-section (FIGS. 8 and 9). The forming member 50 is supported for vertical movement on the support housing 44 by upstanding vertical support plates 51, 52 (FIG. 3) fixed between the sidewalls of the forming member 50 and vertically extending guide plates 53, 54 fixed to and extending downwardly from the support housing 44. Suitable slots are provided in the plates 51, 52 and aligned with guide bolts fixed in the plates 53, 54 (FIGS. 4 and 5) so that the forming member 50 may be raised and lowered, relative to the support housing 44. As an additional guide for vertical movement of the forming member 50, the rear plate 57 of the forming member 50 is also provided with vertical slots which are aligned with the bolts in a vertical rear plate 58 of the support housing 44.

The rear and forward portions of the forming member 50 are supported for vertical adjustment on the lower ends of support posts 60, 61 (FIGS. 4 and 5), the upper portions of which extend up into adjustment sleeves 62, 63, supported at their upper ends on cross members 64, 65 of the support housing 44. The upper end portions of the posts 60, 61 are threaded and threadably engage the threads on the inside of the sleeves 62, 63. Thus, when the sleeves 62, 63 are rotated, the posts 60, 61 are raised or lowered, depending upon the direction of rotation of the sleeves 62, 63.

Figure 6:
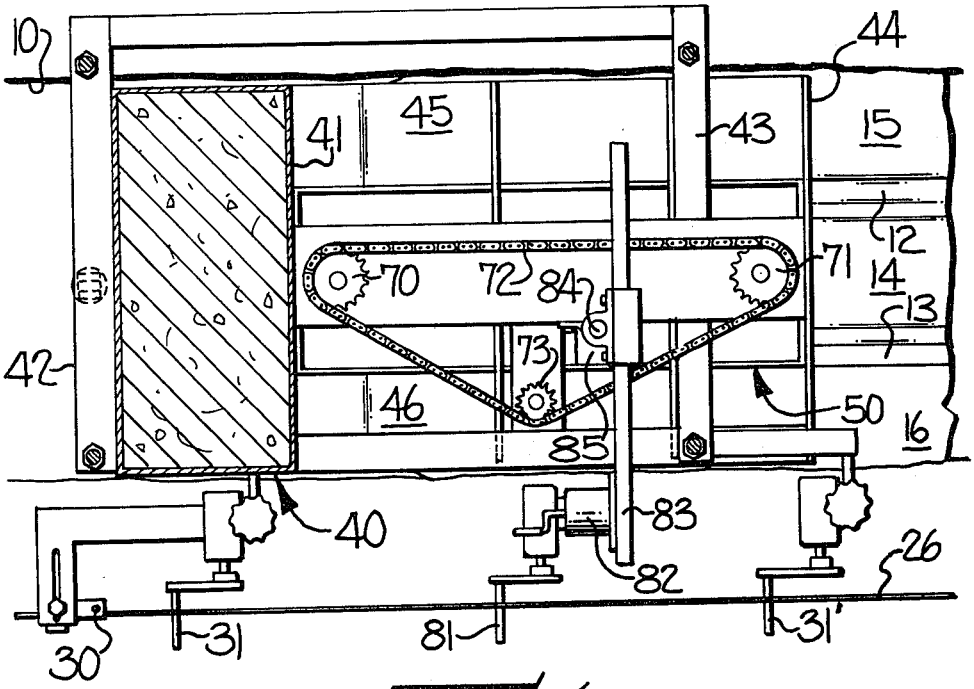
FIG. 6 is a fragmentary horizontal sectional view taken substantially along the line 6—6 in FIG. 4.

Respective shafts 66, 67 extend downwardly into and are drivingly connected to the sleeves 62, 63. The upper ends of the shafts 66, 67 are provided with sprockets 70, 71 which are engaged by a control drive chain 72 (FIG. 6). The control drive chain 72 also engages a sprocket 73 which is fixed on the drive shaft of a reversible hydraulic motor 74, suitably supported on the support housing 44. Rotation of the hydraulic motor 74 is controlled, in a manner to be presently described, to raise and lower the forming member 50 by rotation of the sleeves 62, 63. Extremely accurate control of the vertical position of the forming member 50 is obtained by the "screw-jack" type adjustment provided by the sleeves 62, 63 and posts 60, 61.

Figure 5:
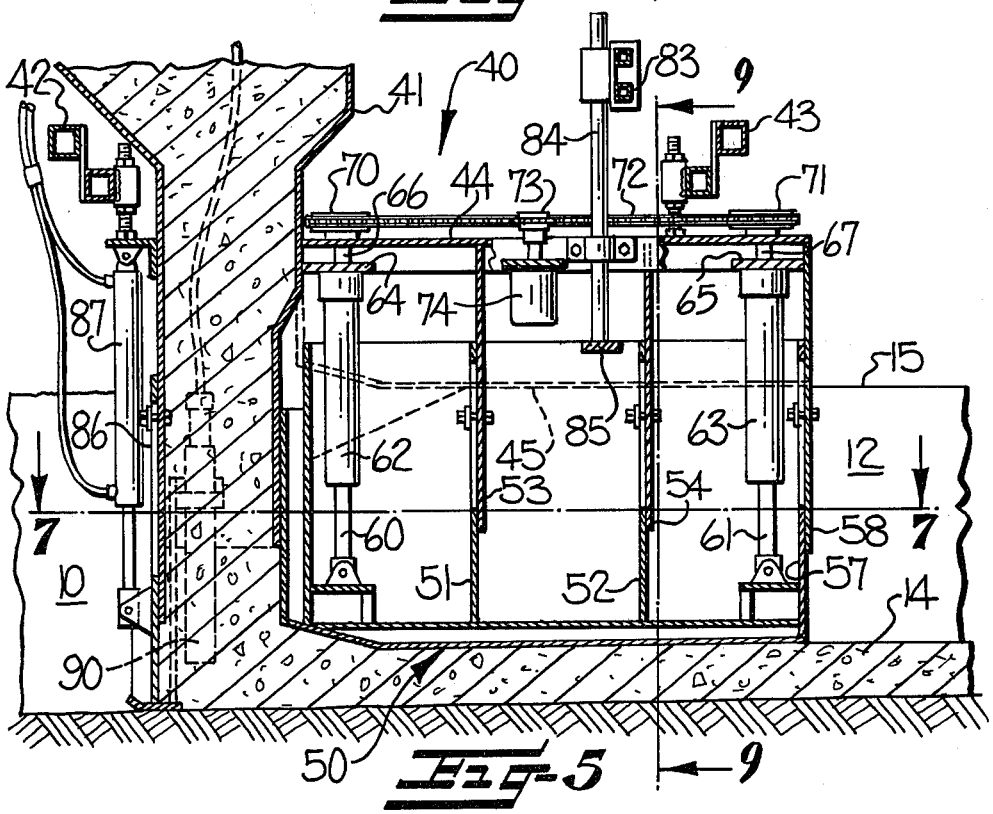
FIG. 5 is a view similar to FIG. 4 but showing the slip mold in a lower position to provide the desired slope or fall to the bottom of the ditch.

Secondary control means is associated with the forming member 50 for vertically adjusting the forming member 50 relative to the frame 21 so that the slope of the interior bottom surface 14 of the concrete lining is accurately controlled as the prime mover means 20 propels the mold means 40 along the previously dug ditch 10. This secondary control means includes a secondary control wire or line 76 which is suitably supported on the support stakes 27, spaced along the side of the ditch 10. The control line or wire 76 is accurately positioned to provide the required slope, grade or fall to the bottom surface 14 of the concrete lining. The secondary control means also includes a horizontal line follower 81 (FIG. 1), supported on the lower end of a vertical adjustment rod 82. The upper end of the rod 82 is adjustably supported on the outer end of a horizontal slide bar 83, the inner end of which is fixed on the upper end of a vertical shaft 84 (FIG. 5). The shaft 84 is supported for vertical sliding movement on the support housing 44 and its lower end is fixed on a plate 85 (FIG. 9) fixed to the upper portion of the forming member 50.

The line follower 81 is similar in operation to the horizontal line follower 31, and is maintained in contact with the control wire 76. The line follower 81 controls operation of the hydraulic motor 74 and operates the same in response to signals received from the control wire 76 to rotate the adjustment sleeves 62, 63 and thereby vertically adjust the position of the forming member 50, relative to the support housing 44 as the prime mover 20 moves the apparatus along the ground and adjacent the ditch. The open lower rear end of the hopper 41, together with the sides and bottom of the ditch 10 and the slip mold 50 define an extrusion opening through which the concrete material passes to form the U-shaped concrete lining in the ditch as the prime mover means 20 moves along the ground and adjacent the ditch 10.

The front lower portion of the hopper 41 is provided with a vertical guide plate 86 which is supported for vertical adjustment on the front of the hopper 41. A hydraulic cylinder 87 is connected at its lower end to the guide plate 86 and its upper end is connected to the front of the hopper 41. The operation of the hydraulic cylinder 87 may be manually controlled by the operator to maintain the lower portion of guide plate 86 moving along the bottom of the ditch as the forming member 50 is lowered during operation. The guide plate 86 prevents the concrete from being fed forwardly in the ditch when the depth of the ditch increases.

Figure 7:
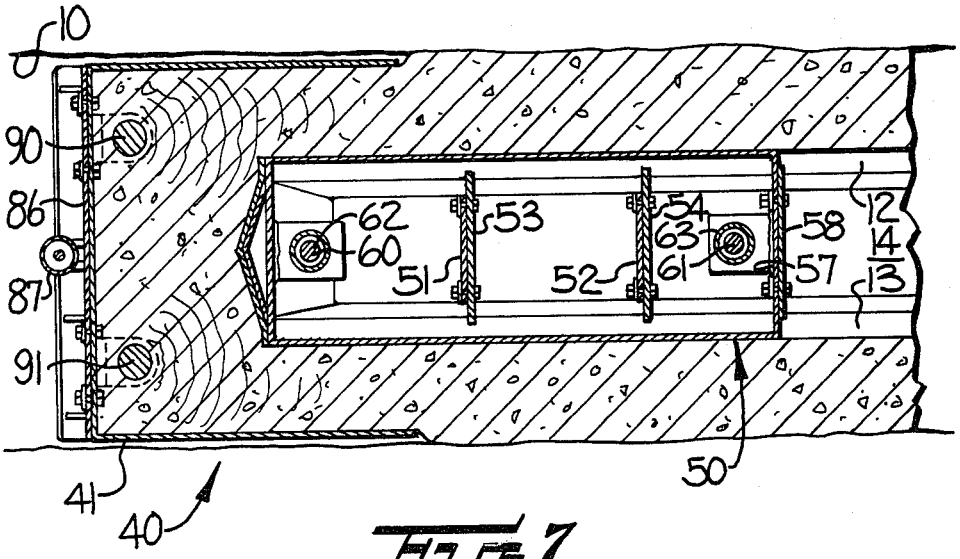
FIG. 7 is a horizontal sectional view taken substantially along the line 7—7 in FIG. 5.

To aid the feeding of the concrete downwardly and through the hopper 41, it is preferred that a pair of vibrators 90, 91 (FIG. 7) be supported on the inner surface of the front plate of the hopper 41. The vibrators are of a conventional type and aid in the compaction of the concrete material as it passes around the forming member 50.

Limit means is associated with the forming member 50 for limiting the vertical movement of the forming member 50 relative to the hopper 41 and the frame 21. This limit means includes a first limit switch 95 (FIGS. 8 and 9) fixed on the slide plate 45 and a cooperating stop plate 96 fixed on the upper portion of the forming member 50 and positioned to engage and operate the limit switch 95 to stop operation of the apparatus when the forming member 50 is moved to a predetermined lower position. A second limit switch 97 (FIGS. 8 and 9) is fixed on the frame of the hopper 41 and adapted to be engaged and operated to stop operation of the apparatus when engaged by the upper portion of the forming member 50 when it is moved to a predetermined upper position, as shown in FIG. 8.

METHOD OF OPERATION

In order to form the substantially U-shaped concrete lining within a drainage ditch or the like, the ditch 10 is first dug of the desired width and depth, with the depth being gradually increased to provide approximately the desired amount of slope, grade or fall to the ditch. The primary control line 26 is then positioned along one side of the ditch 10 and maintained in position by the support stakes 27. The level of the primary control line 25 is determined by the level that the upper walls 15, 16 of the concrete lining are formed, usually at the level of the ground adjacent the ditch. The secondary control line 76 is then accurately positioned and supported by the stakes 77 and adjacent the opposite side of the ditch 10. The line 76 is supported with a slope corresponding to the slope, grade or fall to be formed along the bottom wall 14 of the concrete lining.

The self-propelled apparatus of the present invention is then aligned with and moved along the ditch 10 with the line followers 30, 31, 31' in engagement with the primary control line 26 and the line follower 81 in engagement with the secondary control line 76. A supply of concrete is maintained in the hopper 41 and as the prime mover means 20 moves along the ground surface, the vertical position of the frame 21 is continuously adjusted, in accordance with the position of the primary control line 26, to control the position of the slide plates 45, 46, the hopper 41, and the forming member support housing 44. As the apparatus moves along the ditch 10, the secondary control wire 76 is engaged by the follower 81 and controls the direction and amount of rotation of the hydraulic motor 74 to thereby gradually lower the forming member 50, relative to the housing 44. Different vertical positions of the forming member 50, relative to the support housing 44 and the hopper 41, are illustrated in FIGS. 8 and 9. In FIG. 8, the forming member 50 is shown in the upper position it occupies during the initial formation of a concrete lining. The forming member 50 is shown in FIG. 9 in the lower position it occupies after it has moved downwardly in a gradual manner to accurately form the slope, grade, or fall of the bottom wall 14 of the concrete lining.

The primary control line 26 and associated line followers 30, 31, 31' control the direction of movement and the elevation or vertical level of the frame 21, hopper 41 and the forming member support housing 44 while the secondary control line 76 and associated line follower 81 controls the vertical position of the forming member 50, relative to the hopper 41, support housing 44 and frame 21. Since vertical adjustment of the forming member 50 is controlled independently of vertical adjustment of the hopper 41, the slope, grade or fall of the interior bottom wall 14 of the concrete lining is accurately controlled.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A self-propelled apparatus for extruding and forming a substantially U-shaped concrete lining within a previously dug ditch, characterized by the ability to form the concrete lining within the ditch while accurately controlling the slope of the interior bottom surface of the lining, and comprising the combination of:

(a) prime mover means for propelling said apparatus along the ground surface, said prime mover means including a frame and a plurality of rotatable drive members supporting said frame for movement over the ground surface, (b) primary control means associated with said prime mover means for causing said prime mover means to follow a predetermined path of travel adjacent the ditch and to vertically adjust said frame relative to said rotatable members to maintain said frame moving at a predetermined elevation, (c) a hopper carried by said frame and adapted to extend downwardly into the ditch for receiving the concrete material and for directing the same into the ditch, (d) mold means supported on said frame and communicating with said hopper for receiving concrete material from said hopper and for molding the material into a substantially U-shaped lining within the ditch in covering relation to the bottom and sides thereof as the apparatus moves along the ground, said mold means including a forming member supported for vertical movement with respect to said frame, said forming member being substantially U-shaped in cross-section and defining with the sides and bottom of the ditch an extrusion opening through which the concrete material passes to form the U-shaped concrete lining in the ditch as said prime mover means moves along the ground, and (e) secondary control means associated with said forming member for vertically adjusting the same relative to said frame and independently of the level of the bottom of the ditch, said secondary control means including forming member adjustment means for varying the vertical position of said forming member relative to said hopper so that the slope of the interior bottom surface of the concrete lining is accurately controlled as said prime mover means propels said apparatus along the ground surface and adjacent the previously dug ditch.

2. An apparatus according to claim 1 wherein said primary control means includes a vertical line follower carried by said frame and being adapted to engage and follow a control line supported adjacent the previously dug ditch, guidance means responsive to said vertical line follower for causing said prime mover means to propel said apparatus in the proper direction, a horizontal line follower carried by said frame and being adapted to engage and follow the control line, and frame adjustment means responsive to said horizontal line follower for vertically adjusting said frame relative to said drive members to maintain said frame at a predetermined elevation.

3. An apparatus according to claims 1 or 2 wherein said secondary control means comprises a horizontal line follower carried by said forming member and being adapted to engage and follow a secondary control line supported in adjusted position and adjacent the previously dug ditch, and said forming member adjustment means being responsive to said horizontal line follower.

4. An apparatus according to claim 1 wherein said mold means also includes a forming member support housing including forward and rearward ends, said forward end of said support housing being fixed on said hopper and said rear end of said support housing being fixed on said frame, and a horizontally disposed slide mold plate fixed at each side of said support housing for forming the upper walls of the concrete lining.

5. An apparatus according to claim 4 wherein said forming member is supported for vertical adjustment in said support housing and between said slide mold plates.

6. An apparatus according to claim 1 including a guide plate supported for vertical movement on the front of said hopper and including a lower free end, and means for vertically adjusting said guide plate relative to said hopper so that said lower free end may be maintained adjacent the bottom of the ditch as said apparatus is moved along the ground.

7. An apparatus according to claim 1 wherein said mold means is supported on and extends outwardly in offset relationship adjacent one side of said frame.

8. An apparatus according to claim 1 wherein said secondary control means for vertically adjusting said forming member includes mated threaded members connecting said forming member to said frame, and including means for rotating said threaded members relative to each other to selectively raise and lower said forming member relative to said frame.

9. An apparatus according to claim 8 wherein said mated threaded members comprise a screw jack supported in a vertical position adjacent the front and rear of said forming member, and wherein said means for rotating said threaded members comprises a drive sprocket fixed on each of said screw jacks, a drive chain drivingly connecting said drive sprockets, and a reversible drive motor operated by said secondary control means and drivingly connected to said drive chain for simultaneously rotating said drive sprockets.

10. An apparatus according to claim 1 including limit means associated with said forming member for limiting the vertical movement of said forming member relative to said hopper and said frame.

11. An apparatus according to claim 10 wherein said limit means comprises a first limit switch operable to stop operation of said apparatus when said forming member is moved to a predetermined lower position, and a second limit switch operable to stop operation of said apparatus when said forming member is moved to a predetermined upper position.

12. A self-propelled apparatus for extruding and forming a substantially U-shaped concrete lining within a previously dug ditch, characterized by the ability to form the concrete lining within the ditch while accurately controlling the slope of the interior bottom surface of the lining, and comprising the combination of:

(a) prime mover means for propelling said apparatus along the ground surface, said prime mover means including a frame and a plurality of rotatable drive members supporting said frame for movement over the ground surface, (b) a hopper carried by said frame and adapted to extend downwardly into the ditch for receiving the concrete material and for directing the same into the ditch, (c) mold means supported on said frame and communicating with said hopper for receiving concrete material from said hopper and for molding the material into a substantially U-shaped lining within the ditch in covering relation to the bottom and sides thereof as the apparatus moves along the ground, said mold means including a forming member supported for vertical movement with respect to said frame, said forming member being substantially U-shaped in cross-section and defining with the sides and bottom of the ditch an extrusion opening through which the concrete material passes to form the U-shaped concrete lining in the ditch as said prime mover means moves along the ground, and (d) control means associated with said forming member for vertically adjusting the same relative to said frame and independently of the level of the bottom of the ditch, said control means including forming member adjustment means for varying the vertical position of said forming member relative to said hopper so that the slope of the interior bottom surface of the concrete lining is accurately controlled as said prime mover means propels said apparatus along the ground surface and adjacent the previously dug ditch.

13. An apparatus according to claim 12 wherein said control means comprises a horizontal line follower carried by said forming member and being adapted to engage and follow a control line supported in adjusted position and adjacent the previously dug ditch, and said forming member adjustment means being responsive to said horizontal line follower.

14. An apparatus according to claims 12 or 13 wherein said mold means is supported on and extends outwardly in offset relationship adjacent one side of said frame.

* * * * *